US005445100A

United States Patent [19]

Finkl

[11] Patent Number: 5,445,100

[45] Date of Patent: Aug. 29, 1995

[54] DUAL RUDDER SYSTEM FOR TRIMMING PLANING-TYPE HULLS

[76] Inventor: Anthony W. Finkl, 445 E. Royal Flamingo Dr., Sarasota, Fla. 34236

[21] Appl. No.: 206,473

[22] Filed: Mar. 4, 1994

[51] Int. Cl.[6] ..... B63H 25/06

[52] U.S. Cl. ..... 114/163

[58] Field of Search ..... 114/163, 164, 285

[56] References Cited

U.S. PATENT DOCUMENTS

| | | | |
|---|---|---|---|
| 809,064 | 1/1906 | Johnson . | |
| 1,779,075 | 10/1930 | Plum . | |
| 2,595,863 | 5/1952 | Loofbourrow . | |
| 2,832,304 | 4/1958 | Elyosius et al. . | |
| 3,247,820 | 4/1966 | White . | |
| 3,370,561 | 2/1968 | Ilon . | |
| 3,477,400 | 11/1969 | Walker . | |
| 3,602,178 | 8/1971 | White . | |
| 3,628,486 | 12/1971 | Bennett . | |
| 3,710,749 | 1/1973 | Duryea | 114/163 |
| 3,872,817 | 3/1975 | Duryea | 114/163 |
| 3,938,463 | 2/1976 | Hecker et al. . | |
| 4,085,694 | 4/1978 | Schilling et al. | 114/163 |
| 4,088,091 | 5/1978 | Smith . | |
| 4,383,828 | 5/1983 | Wynne . | |
| 4,421,489 | 12/1983 | Van Veldhuizen | 114/163 |
| 4,428,734 | 1/1984 | Ludlow . | |
| 4,597,742 | 7/1986 | Finkl . | |
| 4,635,577 | 1/1987 | Palmquist | 114/163 |
| 4,689,026 | 8/1987 | Small . | |
| 4,854,903 | 8/1989 | Sirois . | |
| 4,967,682 | 11/1990 | O'Donnell . | |
| 5,249,994 | 10/1993 | Finkl . | |

FOREIGN PATENT DOCUMENTS

| | | |
|---|---|---|
| 1,139,479 | 2/1957 | France . |

*Primary Examiner*—Jesus D. Sotelo
*Attorney, Agent, or Firm*—Baker & McKenzie

[57] ABSTRACT

An improved dual rudder system for use with marine vessels is provided that provides both steering and attack angle adjustment. Specifically, the dual rudder system of the present invention may be adjusted so the rudders can be positioned in a toe-in position for lowering the stern and a toe-out position for raising the stern. In addition, the dual rudder system of the present invention also provides steering capabilities. The two rudders are disposed on opposing sides and substantially aft of the propeller. The system is especially useful for inboard motorboats having a propeller shaft that passes through the rear portion of the hull.

3 Claims, 2 Drawing Sheets

DUAL RUDDER SYSTEM FOR TRIMMING PLANING-TYPE HULLS

FIELD OF THE INVENTION

This invention relates generally to inboard motorboats with planing-type hulls. The improvement contributed by this invention lies in a dual rudder system that provides both a steering function as well as a hull trimming function. More specifically, the present invention provides a dual rudder system that is capable of raising and lowering the transom as well as steering the vessel.

BACKGROUND OF THE INVENTION

The present invention is directed to an improved apparatus and method for controlling the angle of attack of planing-type hulls. More specifically, the present invention provides a dual rudder steering system that both steers the boat and also controls the attack angle or attitude of the planning-type hull.

An understanding of the contribution made by the present invention requires an understanding of planing-type boat hulls. Boats having planing hulls are designed to operate most efficiently at speeds where the hull "planes" on top of the water with a minimum area of the hull in contact with the surface of the water. The percentage or portion of the hull surface area that comes in contact with the water during optimum planing operation of the boat depends largely upon hull design. Typically, more than half of the hull surface is in contact with the surface at planing speeds. However, with hulls having a transom dead rise, or an upward angle from the keel to the chine, less than one-half of the hull may be wetted or in contact with the surface at planing speeds. Further, as little as one-fourth of the surface area of high performance planing-type hulls may be in contact with the surface during optimum high speed operation.

In order to efficiently operate a boat with a planing-type hull at planing conditions, the attack angle or trim angle of the hull must be carefully controlled. If the bow is too high and the stern is too low, the attack angle is too high or too positive (i.e. +5°) and the hull will operate inefficiently and even oscillate. If the bow is too low and the stern is too high, the attack angle is too low or too negative (i.e. −3°) and the hull operates inefficiently from excessive wetted surface. It is therefore important to operate the boat with the hull in a near horizontal position or optimal attack angle. The specific optimal attack angle will depend upon the boat design, hull design and the speed at which the boat is travelling.

One way to control the attack angle of the boat with a planing-type hull is the use of hydrofoils. Hydrofoils can be used to both raise or lower the transom and therefore adjust the attack angle in the positive direction (i.e. lowering the stern) or the negative direction (i.e. raising the stern). However, the use of hydrofoils is not without its drawbacks. Primarily, the addition of two hydrofoils increases the drag of the boat in the water and decreases efficiency. Further, the hydrofoils are manually controlled and the effective operation of hydrofoils can be a difficult skill to learn. Further, the cost of two hydrofoils (one for each chine) along with the equipment used to control the angle of the hydrofoils in the water is expensive and can add substantially to the cost of the boat.

In inboard motorboats, as shown in U.S. Pat. No. 5,249,994 issued to applicant, it has been found that it is advantageous to pass the propeller shaft through the hull of the boat as opposed to the transom. Specifically, when the propeller shaft is passed through the hull of the boat, a conventional shaft log and conventional packing gland may be used to seal the portion of the hull where the propeller passes through. In contrast, when the propeller shaft is passed through the transom of the boat, special shaft ports, radial thrust bearings and packing glands are required thereby increasing the cost of manufacture.

However, in the economical design where the propeller shaft is passed through the hull of the boat, the larger propeller shaft angle in relation to the keel increases the vertical lift at or near the transom/hull junction thereby causing the transom to rise and lowering the attack angle. The lift generated by the propeller shaft angle and action of the propeller can be quite large and further cause the transom to be raised past an optimum point whereby the hull may reach a negative attack angle which causes the boat to operate inefficiently.

Accordingly, it would be highly desirable to provide an alternative to hydrofoil systems or an alternative means for controlling the attack angle of the boat that does not substantially add to the cost of the boat or substantially contribute to hull drag. The present invention proposes to do this by employing a dual rudder mechanism that both steers the boat and also controls the attack angle of the boat.

Dual rudders are known in the art. Specifically, a rudder disposed on either side of the propeller and preferably directly behind the propeller is an effective steering mechanism because the propellers receive the maximum thrust of the high velocity water emanating from the rotating propeller.

The present invention provides a specially designed dual rudder steering system that is capable of controlling the attitude of the hull. The specially designed dual rudder steering system of the present invention is especially adaptable to boats with planing-type hulls and inboard motor boats where the propeller shaft angle is relatively steep due to the passing of the propeller shaft through the rear of the hull as opposed to the transom.

SUMMARY OF THE INVENTION

The present invention makes a significant contribution to the high performance motorboat art by providing an improved dual rudder system that is capable of adjusting the angle of attack of the hull in addition to providing superior steering capabilities.

The improved dual rudder includes two rudders disposed on opposing sides of the propeller. Preferably, a substantial proportion of each rudder is disposed behind or aft of the propeller blades so that the high velocity water emanating from the rotating propeller blades engages the inner sides of the rudders to enhance the steering capabilities of the rudders. Each rudder is connected to an upwardly extending rudder shaft which in turn is connected to a forwardly extending tiller arm. The tiller arms of each rudder are connected by a means for varying the distance between the two tiller arms. The means for varying the distance between the two tiller arms can take the form of a turnbuckle tie rod mechanism, a hydraulic cylinder or other motorized or manually operated but adjustable linkage mechanisms. By adjusting the distance between the two tiller arms which are connected at right angles to the rudder shafts, the normally parallel relationship between the two rudders is adjusted.

Specifically, by shortening the distance between the two normally parallel tiller arms, the two rudders are positioned in what is known as a "toe-in" position whereby the front edges of the rudders are directed toward one another and the inside surfaces of the rudders are no longer in a parallel relationship. The toe-in position of the rudders causes a pressure reduction above the rudders and under the transom thereby lowering the transom. If the propeller angle is substantial and the thrust of the propeller is causing the transom to be raised above a preferable elevation, the toe-in position will lower the transom and reduce the wetted surface area of the hull and therefore return the boat to a more efficient angle of attack or attitude. In short, a toe-in position of the rudders lowers the stern and increases the angle of attack.

When the distance between the two tiller arms is increased, the rear edges of the rudders are directed toward one another and the front edges of the rudders are directed away from each other. This position is known as a "toe-out" position. The toe-out position causes an increase in pressure below the transom which has the effect of raising the hull or lowering the angle of attack.

By way of an example, with a 27-foot planing-type hull having a dead rise from the keel to each chine of approximately 13°, the following variation in rudder angle from parallel produced the following results:

A 1° toe-in angle per rudder produced a positive 1.5° angle of attack; a 2° toe-in angle per rudder produced a positive 2.2° angle of attack; a 3° toe-in angle per rudder produced a positive 3° angle of attack; a 1° toe-out angle per rudder produced a negative 0.5° angle of attack; a 2° toe-out angle per rudder produced a negative 1.0° angle of attack; and a 3° toe-out angle per rudder produced a negative 2.7° angle of attack.

Accordingly, it is an object of the present to provide an improved dual rudder steering system that has the capabilities of adjusting the attack angle of the hull.

Another object of the present invention is to provide a dual rudder system for a single propeller boat that improves the ability of the boat to back down and maneuver in confined areas.

Yet another object of the present invention is to provide an alternative or supplement to hydrofoils disposed at or near each chine for adjusting the attack angle of planing-type hulls.

Still another object of the present invention is to provide a steering system that is capable of adjusting the attitude of a planing-type hull.

Other objects and advantages of the present invention will become apparent upon reading the following detailed description of the invention and the claims, and upon reference to the accompanying drawings.

BRIEF DESCRIPTION OF THE DRAWINGS

This invention is illustrated more or less diagrammatically in the accompanying drawings, wherein.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE DRAWINGS

The dual rudder system 10 shown in FIGS. 1–5 provides steering capabilities in addition to hydrofoil capabilities. That is, the dual rudder system 10 shown in FIGS. 1–5 not only steers the boat 12 but also enables the operator to adjust the attack angle of the boat 12 which is a primary function of a hydrofoil system.

Figure 1:
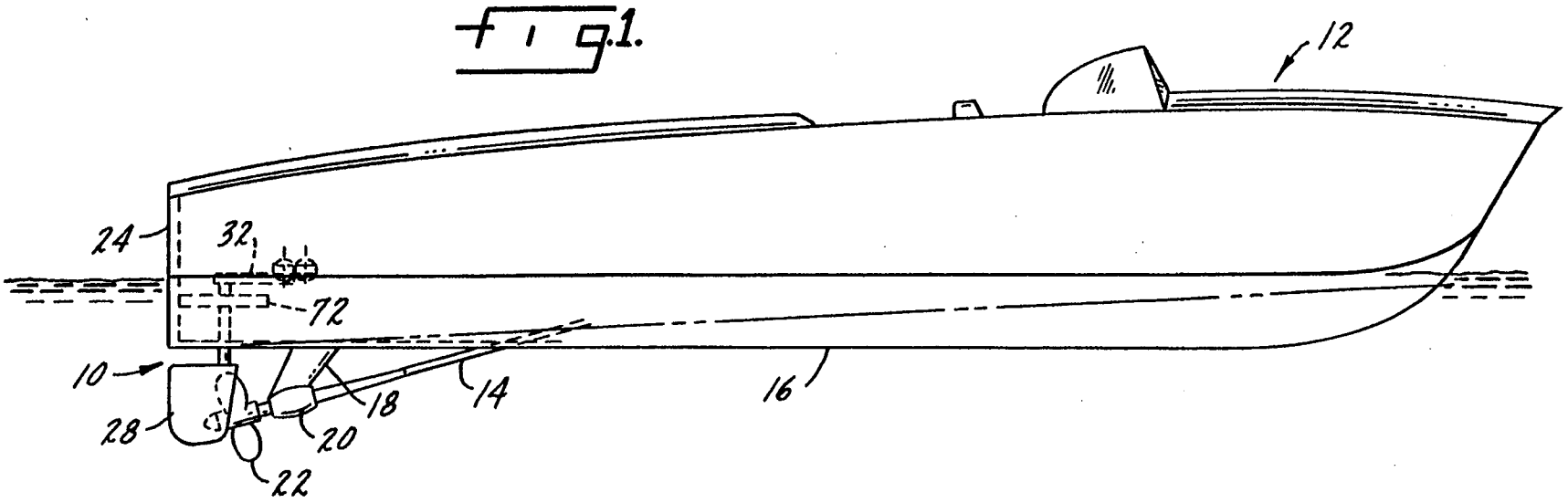
FIG. 1 is a side elevational view of the inboard motorboat equipped with a dual rudder system made in accordance with the present invention.

Turning to FIG. 1, the inboard motorboat 12 includes a propeller shaft 14 that passes through the planing-type hull 16. The propeller shaft 14 is supported by a conventional strut 18 and strut bearing 20. The propeller 22 is disposed below the transom 24.

Figure 2:
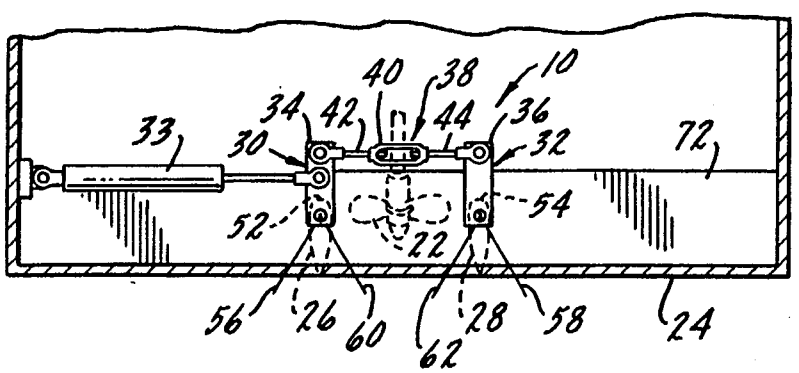
FIG. 2 is an enlarged top plan view of the stern portion of the boat shown in FIG. 1.

Referring to FIGS. 1 and 2 collectively, the dual rudders 26, 28 are disposed on opposing sides of the propeller 22. Each rudder 26, 28 is connected to a tiller arm 30, 32. In the embodiment shown in FIG. 2, the steering mechanism indicated generally at 33 is connected to the starboard tiller arm 30.

Figure 3:
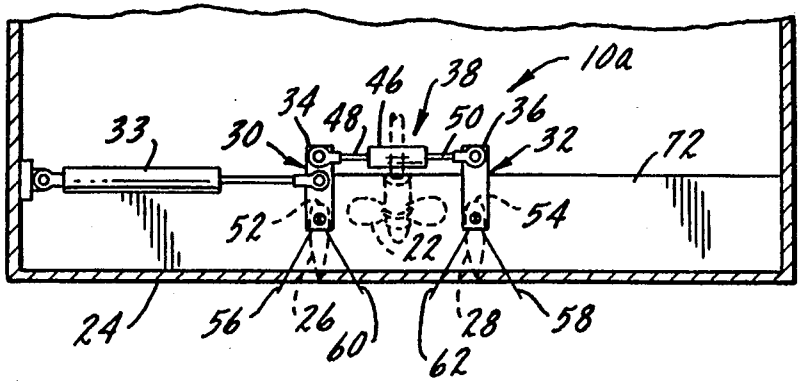
FIG. 3 is an enlarged top plan view of an alternative embodiment of a dual rudder system still made in accordance with the present invention.

The angle of attack of the boat 12 is adjusted by varying the distance between the tiller arms 30, 32 and, in the embodiments shown in FIGS. 2 and 3, the distal ends 34, 36 of the tiller arms 30, 32. The means for adjusting the distance between the tiller arms 30, 32 is shown generally at 38. In the embodiment shown in FIG. 2, the means for adjusting the distance between the tiller arms 30, 32 is a turnbuckle tie-rod apparatus featuring the turnbuckle 40 connecting the distal ends of two tie rods 42, 44. In the embodiment shown in FIG. 3, the means for adjusting the distance between the tiller arms 30, 32 is a hydraulic cylinder 46 connected to tie rods 48, 50.

Returning to FIG. 2, if the distance between the distal ends 34, 36 of the tiller arms, 30, 32 is shortened, the front edges 52, 54 of the rudders 26, 28 respectively are directed inward toward each other. This position is known as a toe-in position, and is further illustrated by the inwardly directed lines 56, 58. In a toe-in position, the pressure is reduced underneath the transom 24 thereby causing the transom 24 to be lowered in the water. Accordingly, a toe-in position achieved by shortening the distance between the tiller arms 30, 32 and further illustrated by the lines 56, 58 results in an increased or a positive attack angle.

Still referring to FIG. 2, if the distance between the tiller arms 30, 32 is lengthened, the inner ends 52, 54 of the rudders 26, 28 will be then directed outward away from each other as illustrated by the lines 60, 62. This position is known as a toe-out position where the inner section of the horizontal planes of the two rudders 26,

28 intersect at a point aft of the propeller. In this position, pressure is generated between the two rudders 26, 28 and therefore pressure is increased underneath the transom 24 causing the transom 24 to rise. Accordingly, as the transom 24 is caused to rise, the attack angle is lowered and a negative attack angle can be achieved.

In summary, if the attack angle is too high or the stern is too low and the bow is too high, the operator of the boat 12 may then lengthen the distance between the tiller arms 30, 32 thereby causing the front edges 52, 54 of the rudders 26, 28 to be directed outward away from each other which increases the pressure underneath the transom 24 causing the transom to rise. The attack angle will thereafter be lowered which will decrease the surface area of the wetted hull thereby increasing efficiency. On the other hand, if the bow is too low and the transom is too high and therefore the attack angle is too low or too negative, the operator of the boat 12 may then shorten the distance between the tiller arms 30, 32 which will cause the front edges 52, 54 of the rudders 26, 28 to move toward one another. This action will result in a toe-in position thereby reducing water pressure under the transom 24 causing the transom 24 to be lowered.

Figure 4:
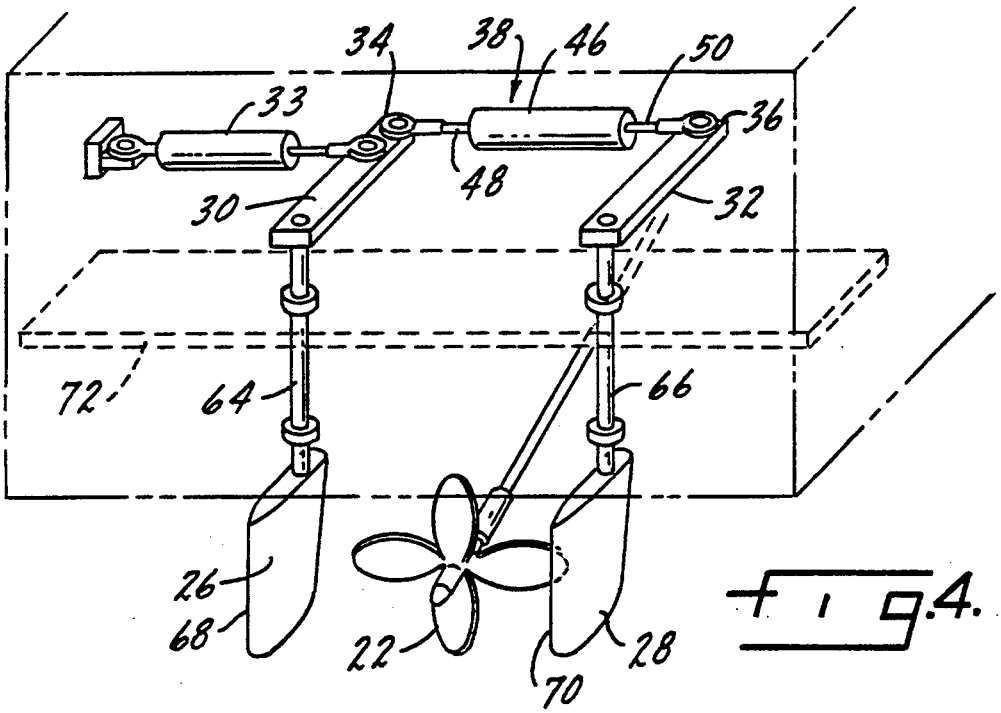
FIG. 4 is an enlarged rear perspective view of the embodiment shown in FIG. 3.
Figure 5:
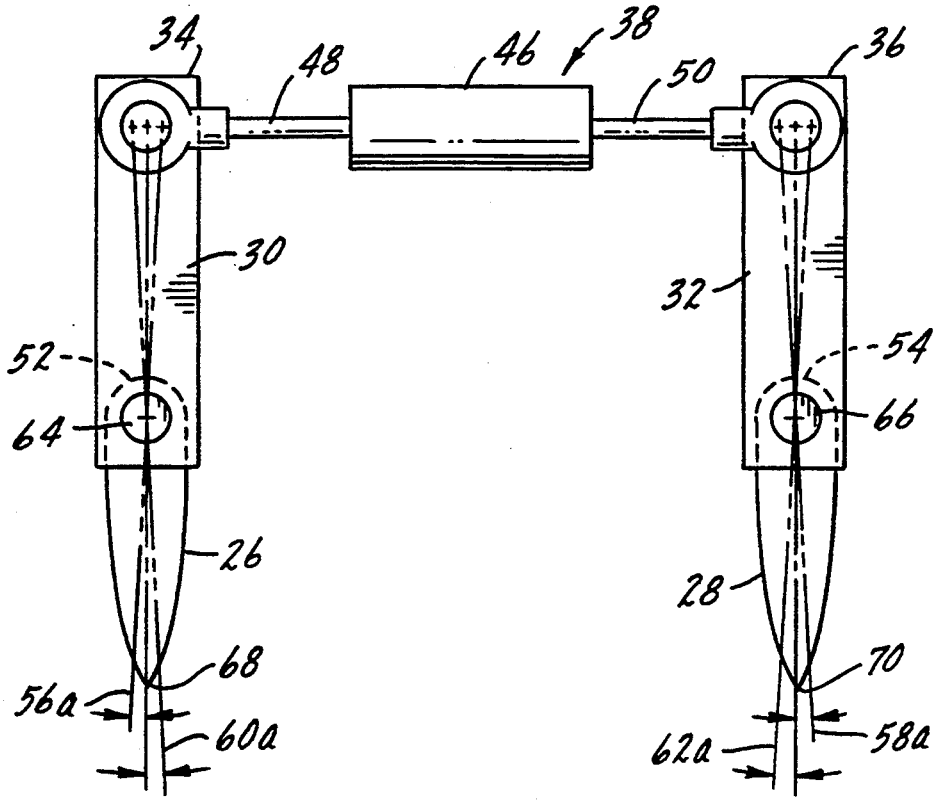
FIG. 5 is an enlarged top plan view of the embodiment shown in FIG. 4.

As noted above, FIG. 3 is an illustration of a hydraulic cylinder 46 used in the place of the turnbuckle 40 as shown in FIG. 2. Turning to FIG. 4, a more detailed illustration of the dual rudder system 10 is provided. Each rudder 26, 28 is connected to an upwardly protruding rudder shaft 64, 66. The rudder shafts 64, 66 are connected to the tiller arms 30, 32 respectively. The distal ends 34, 36 of the tiller arms 30, 32 are connected to the rods 48, 50 of the hydraulic cylinder means 46. As seen in FIG. 5, by extending the rods 48, 50 outwardly, the front edges 52, 54 of the rudders 26, 28 are directed away from one another and the trailing edges 68, 70 of the rudders 26, 28 respectively will be directed toward one another as shown in FIG. 5. In contrast, when the rods 48, 50 are moved toward one another by the hydraulic cylinder means 46, the forward or leading edges 52, 54 of the rudders 26, 28 will also be moved toward one another and the trailing edges 68, 70 of the rudders 26, 28 will be directed away from each other to assume a toe-in position. Also illustrated in FIG. 4 is the passing of the rudder shafts 64, 66 through the hull 16 and through the rudder table 72".

It will also be noted from FIG. 5 the stroke of the cylinder 46 or, alternatively, the turnbuckle 40 (see FIG. 2) need only be approximately 2' and sometimes even less. The degree of toe-out movement or toe-in movement to effectively control the attitude of the hull 12 is relatively small. The lines 56, 58, 60, 62 of FIGS. 2 and 3 have been exaggerated for purposes of illustration. More representative angles are indicated at the lines **56*a*, 58*a*, 60*a*, 62*a* as shown in FIG. 5**. In fact, the maximum toe-in angle and toe-out angle for most application need only be approximately 3°. The following toe-in and toe-out angles had the following effects on the angle of attack for a 27-foot planing-type hull with a dead rise of 13°:

A 1° toe-in angle per rudder produced a positive 1.5° angle of attack; a 2° toe-in angle per rudder produced a positive 2.2° angle of attack; a 3° toe-in angle per rudder produced a positive 3° angle of attack; a 1° toe-out angle per rudder produced a negative 0.5° angle of attack; a 2° toe-out angle per rudder produced a negative 1.0° angle of attack; and a 3° toe-out angle per rudder produced a negative 2.3° angle of attack. An adjustment of 1° in angle of attack can dramatically affect the wetted surface area of the planing-type hull and therefore dramatically affect efficiency of the boat. The rudders discussed above are displaced $1\frac{3}{4}$", from the propeller.

Further, angles in excess of 3° per rudder will most likely need to be avoided for most applications because additional drag caused by the rudders not being in a substantially parallel relationship may offset the efficiency gains achieved from an improved attack angle. Accordingly, the toe-in and toe-out angles of the rudder should be changed in small increments.

It will also be noted that the dual rudder system 10 illustrated in FIGS. 1–5 is a superior steering mechanism. The rudders 26, 28 are disposed adjacent to the propeller 22 and slightly aft of the propeller 22 so the rudders 26, 28 receive the maximum thrust of the high-velocity water emanating from the propeller 22. The high-velocity water reflecting off of the rudders 26, 28 further enhances the steering capability of the dual rudder system 10.

Finally, it will be noted that the dual rudder system 10 of the present invention is useful when operating the vessel 12 in reverse or "backing down". A dual rudder system 10 gives the pilot of a single propeller boat 12 greater maneuverability than a single rudder system and, in many respects, backs down like a dual propeller boat.

Although only two preferred embodiments of the present invention have been illustrated and described, it will at once be apparent to those skilled in the art that variations may be made within the spirit and scope of the present invention. Specifically, a variety of means for adjusting the distance between the tiller arms will be apparent to those skilled in the art. Further, the means for adjusting the distance between the tiller arms could be replaced by a means for rotating or twisting the rudder shafts to achieve the desired to-in or the toe-out position. Accordingly, it is intended that the scope of the invention be limited solely by the scope of the hereafter appended claims and not by any specific wording in the foregoing description.

I claim:

1. A dual rudder system for a marine vessel equipped with a propeller disposed below a transom of the vessel, the vessel also equipped with a planing-type hull, the dual rudder system enabling the operator to adjust the angle of attack of the planing-type hull while the vessel is being operated at planing conditions, the dual rudder system comprising:

first rudder connected to an upwardly protruding first rudder shaft, the first rudder shaft passing through the hull, an upper end of the first rudder shaft connected to a front end of a first forwardly directed tiller arm, the first rudder and first rudder shaft disposed substantially aft of the propeller, a second rudder connected to an upwardly protruding second rudder shaft, the second rudder shaft passing through the hull, an upper end of the second rudder shaft connected to a front end of a second forwardly directed tiller arm, the second rudder and second rudder shaft disposed substantially aft of the propeller, one of said tiller arms connected to a steering mechanism, the first and second rudders being disposed on opposing sides of the propeller, the first and second tiller arms each including rear ends, the rear ends of the first and second tiller arms being connected by a length-adjustable linkage whereby adjustment of the length-adjustable linkage results in varying the distance between the rear ends of the first and second tiller arms which results in a rotation of the first and second rudders about their respective vertical axes as defined by the first and second rudder shafts, said rotation of the first and second rudders occurring about their respective vertical axes only, the first and second rudders maintaining a vertical orientation at all times, rotation of the first and second rudders about their respective vertical axes enabling the first and second rudders to assume a plurality of toe-out positions wherein lower edges of the rudders are directed toward each other, a parallel position wherein the first and second rudders are generally parallel with respect to one another and a toe-in position where the lower edges of the rudders are directed away from each other, the toe-out, toe-in and parallel positions affecting the attitude of the planing-type hull when the vessel is operated at planing-type conditions, whereby adjustment of the length-adjustable linkage resulting in adjustment of the attitude of the planing-type hull.

2. A dual rudder system for a marine vessel equipped with a propeller disposed below a transom of the vessel, the vessel also equipped with a planing-type hull, the dual rudder system enabling the operator to adjust the angle of attack of the planing-type hull while the vessel is being operated at planing conditions, the dual rudder system comprising:

first rudder connected to an upwardly protruding first rudder shaft, the first rudder shaft passing through the hull, an upper end of the first rudder shaft connected to a front end of a first forwardly directed tiller arm, a second rudder connected to an upwardly protruding second rudder shaft, the second rudder shaft passing through the hull, an upper end of the second rudder shaft connected to a front end of a second forwardly directed tiller arm, the first and second rudders disposed on opposing sides of the propeller, the first and second rudder shafts disposed on opposing sides of the propeller, the first and second rudders and first and second rudder shafts being disposed substantially aft of the propeller, one of said tiller arms connected to a steering mechanism, the first and second tillers arms each having rear ends, the rear ends of the first and second tiller arms being connected by a length-adjustable turnbuckle tie rod for varying the distance between the rear ends of the first and second tiller arms, varying the distance of the rear ends of the first and second tiller arms by adjusting the length-adjustable turnbuckle tie rod causing the first and second rudders to rotate about a vertical axis defined by the first and second rudder shafts respectively and causing the first and second rudders to assume a plurality of toe-out positions wherein lower edges of the rudders are directed toward each other, a parallel position wherein the first and second rudders are generally parallel with respect to one another and a plurality of toe-in positions where the lower edges of the rudders are directed away from each other, said rotation of the first and second rudders occurring about their respective vertical axes only, the first and second rudders maintaining a vertical orientation at all times, the toe-out, toe-in and parallel positions affecting the attitude of the planing-type hull when the vessel is operated at planing-type conditions, whereby adjustment of the length-adjustable turnbuckle tie rod resulting in adjustment of the attitude of the planing-type hull.

3. A dual rudder system for a marine vessel equipped with a propeller disposed below a transom of the vessel, the vessel also equipped with a planing-type hull, the dual rudder system enabling the operator to adjust the angle of attack of the planing-type hull while the vessel is being operated at planing conditions, the dual rudder system comprising:

first rudder connected to an upwardly protruding first rudder shaft, the first rudder shaft passing through the hull, an upper end of the first rudder shaft connected to a front end of a first forwardly directed tiller arm, a second rudder connected to an upwardly protruding second rudder shaft, the second rudder shaft passing through the hull, an upper end of the second rudder shaft connected to a front end of a second forwardly directed tiller arm, the first and second rudders disposed on opposing sides of the propeller, the first and second rudder shafts disposed on opposing sides of the propeller, the first and second rudders and first and second rudder shafts being disposed substantially aft of the propeller, one of said tiller arms connected to a steering mechanism, the first and second tillers arms each having rear ends, the rear ends of the first and second tiller arms being connected by a length-adjustable hydraulic cylinder for varying the distance between the rear ends of the first and second tiller arms, varying the distance of the rear ends of the first and second tiller arms by adjusting the length-adjustable hydraulic cylinder causing the first and second rudders to rotate about a vertical axis defined by the first and second rudder shafts respectively and causing the first and second rudders to assume a plurality of toe-out positions wherein lower edges of the rudders are directed toward each other, a parallel position wherein the first and second rudders are generally parallel with respect to one another and a plurality of toe-in positions where the lower edges of the rudders are directed away from each other, said rotation of the first and second rudders occurring about their respective vertical axes only, the first and second rudders maintaining a vertical orientation at all times, the toe-out, toe-in and parallel positions affecting the attitude of the planing-type hull when the vessel is operated at planing-type conditions, whereby adjustment of the length-adjustable hydraulic cylinder resulting in adjustment of the attitude of the planing-type hull.

* * * * *